United States Patent [19]

Garner et al.

[11] 4,285,787

[45] Aug. 25, 1981

[54] ELECTROCHEMICAL CORROSION PROTECTION OF STAINLESS STEEL BLEACH PLANT WASHERS

[75] Inventors: Andrew Garner, Pointe Claire, Canada; Laurent H. Laliberte, Mobile, Ala.

[73] Assignee: Pulp and Paper Research Institute of Canada, Pointe Claire, Canada

[21] Appl. No.: 132,011

[22] Filed: Mar. 20, 1980

[51] Int. Cl.[3] ..... C23F 13/00

[52] U.S. Cl. ..... 204/147

[58] Field of Search ..... 204/147, 196

[56] References Cited

U.S. PATENT DOCUMENTS

| | | | |
|---|---|---|---|
| 2,834,728 | 5/1958 | Gallone | 204/196 |
| 3,166,487 | 1/1965 | Owren | 204/196 |
| 3,350,288 | 10/1967 | Almar-Naess | 204/196 |
| 3,476,673 | 11/1969 | Stiles | 204/196 |
| 3,536,601 | 10/1970 | Hill et al. | 204/147 |
| 3,560,365 | 2/1971 | Mueller | 204/147 |
| 3,841,988 | 10/1974 | Gleason | 204/196 |
| 3,876,517 | 4/1975 | Raetzsch et al. | 204/196 |
| 3,972,796 | 8/1976 | Frohler et al. | 204/147 |
| 4,110,181 | 8/1978 | Sluse et al. | 204/147 |

*Primary Examiner*—R. L. Andrews

*Attorney, Agent, or Firm*—Lawrence I. Field

[57] ABSTRACT

A method is provided herein for the electrochemical corrosion protection of a partly submersed, rotating, stainless steel drum in a vat containing a corrosive, oxidizing, chloride-containing bleach liquor. The method comprises the step of impressing a protection potential to the stainless steel drum at a predetermined voltage in the range of −600 to +400 $mV_{Ag/AgCl}$. This predetermined voltage is sufficiently low to draw the stainless steel into a passive corrosion protection zone. However, that voltage is not sufficiently low to draw the stainless steel into a zone of uniform corrosion. Specific means for the placement of the anode in the vat are also provided.

4 Claims, 2 Drawing Figures

ELECTROCHEMICAL CORROSION PROTECTION OF STAINLESS STEEL BLEACH PLANT WASHERS

BACKGROUND OF THE INVENTION (i) Field of the Invention

This invention relates to a method and apparatus for corrosion protection by electrochemical potential control of a stainless steel vessel containing a corrosive washing solution. More particularly, it is directed to a method and apparatus for protecting stainless steel bleach plant washer equipment, used in the pulp industry, from corrosion.

(ii) Description of the Prior Art

Stainless steel is known to be generally resistant to corrosion due to a build-up thereon of passive films. However, such passive films are susceptible to localized breakdown, and this susceptibility is greatly enhanced in the presence of specific ions. The filtrate used in bleach plant washer generally contains oxidants, e.g., chlorine ($Cl_2$), chlorine dioxide ($ClO_2$), or hypochlorite ($OCl^-$) together with a considerable amount of chloride ions. Such filtrate can bring about localized passive film failure. The loss of protection leads to various modes of localized corrosion, the principal ones being crevice corrosion and pitting corrosion.

The corrosion environment in chlorine and chlorine dioxide stage bleach plant washers is generally acidic, with a pH in the range of 1 to 7. The most common alloys of construction are 316L and 317L stainless steel. In a number of cases, the corrosion of these washers has been so severe that the replacement washer was constructed from stainless steel with higher molybdenum content, at significantly higher cost.

One procedure heretofore used to control corrosion in such bleach plant washers was the addition of antichlors, e.g., $SO_2$ or NaOH. Such antichlors as used at present are intended to make the environment conditions in the washer less oxidizing and so less corrosive to the stainless steel washer components. It has been found, however, that under typical chlorine dioxide washing stage conditions, for example, $SO_2$ additions alone will mitigate but will not completely prevent crevice corrosion in many types of stainless steels.

The corrosion environment in hypochlorite stage bleach washers is generally alkaline, with a pH in the range of 8–11. The most common alloy of construction is 316L stainless steel. It would be preferable to use 304L stainless steel since it is much cheaper than 316L stainless steel. However, 304L stainless steel has been largely unsuccessful for this use because of severe chloride crevice corrosion.

Electrochemical corrosion control would seem to offer a solution to the widespread problem of crevice corrosion of stainless steels in bleach washing stages.

Many patents teach the concept of corrosion control by inducing passivity in the metal by anodic polarization techniques. In such technique, the vessel to be protected against corrosion by a chemical contained therein is anodically polarized with respect to an inert electrode suspended in the corrosive liquid in the vessel. An electric current is then passed between an inert electrode suspended in the corrosive liquid in the vessel. An electric current is then passed between the metallic vessel and the inert cathode so as to maintain the electrical potential of the vessel in the passive region. The necessary electrical potential can be determined by means of an anodic polarization curve, or by controlled potential immersion testing. The passive region can be identified after such tests, thus providing data indicative of the potential range within which the vessel should be maintained in order to attempt to minimize corrosion.

Amongst the prior patents dealing with this technique are: Banks et al., U.S. Pat. Nos. 3,371,023 issued Feb. 7, 1968, 3,375,183 issued Mar. 26, 1968, 3,378,472 issued Apr. 16, 1968, 3,379,629 issued Apr. 23, 1968, and 3,409,526 issued Nov. 5, 1968; Elmore et al., U.S. Pat. No. 1,576,581 issued Mar. 16, 1926; Hoey, U.S. Pat. No. 3,442,779 issued May 6, 1969; Poyser, U.S. Pat. No. 4,018,647 issued Apr. 19, 1977; and Hulthe, U.S. Pat. No. 4,036,716 issued July 19, 1977.

Cathodic polarization has also been applied in the past for the protection of metals that do not form passive films, e.g., iron in soil or sea water. It has been applied to stainless steels in neutral sea water solutions, but its application to stainless steels in strongly oxidizing chloride solutions involves a number of possible difficulties mainly concerned with the problem of not destroying the passive film when the potential is lowered to a potential near or below the protection potential. Precise control of the impressed current in a cathodic system is thus a prime requirement.

Amongst the prior patents which relate to the application of cathodic protection of metal surfaces including such precise control of the impressed current are MacTaggart et al., U.S. Pat. No. 2,435,973 issued Feb. 17, 1948; Stephens, Jr., U.S. Pat. No. 3,634,222 issued Jan. 11, 1972; Kipps et al., U.S. Pat. No. 3,692,650 issued Sept. 19, 1972; and Ferry et al., U.S. Pat. No. 4,080,272 issued Mar. 21, 1978.

However, it has been found that, in oxidizing aqueous chloride environments, stainless steels are most susceptible to crevice corrosion. While it is known that crevice corrosion can be arrested by cathodic polarization, that is, by impressing a current between the steel to be protected, and an inert electrode, so that the steel is cathodic with respect to that electrode, it is nevertheless true that if stainless steel is maintained at a cathodic potential in this way, it may undergo general dissolution due to the reduction of the thin surface oxide film which gives the steel its stainless property. Thus, as practiced in the past, cathodic polarization may arrest crevice corrosion but may cause general attack of stainless steel in strongly oxidizing chloride solutions.

Another difficulty in cathodic polarization of stainless steel bleach plant washers is the placement of the anode within the washer. Since the washer consists of a vat containing the bleached pulp to be washed and a perforated or foraminous stainless steel washing drum rotatably mounted within the tank to provide the wash water, a considerable amount of shear force is generated when the drum is rotated which may dislodge the anode.

SUMMARY OF THE INVENTION (i) Aims of the Invention

Accordingly, one object of this invention is to provide a method for the effective electrochemical corrosion protection of stainless steel subjected to the action of a corrosive, oxidizing, chloride-containing liquor.

Another object of this invention is the provision of a novel electrochemically protected bleach plant washer including a vat provided with an anode mounted therein and a rotatably mounted stainless steel electrochemically protected washing drum therein.

(ii) Statements of the Invention

The present invention is embodied by a method of electrochemically protecting by cathodic polarization a partly submersed, rotating, stainless steel drum in a vat containing a corrosive oxidizing chloride containing bleach liquor which comprises impressing a protection potential to the stainless steel drum at a determined voltage in the range of $-600$ to $+400$ $mV_{Ag/AgCl}$, the predetermined voltage being sufficiently low to draw the stainless steel into a passive corrosion protection zone but not sufficiently low to draw it into a zone of uniform corrosion.

The present invention is also embodied by a bleach plant washer comprising (a) a vat; (b) a perforated or foraminous stainless steel washing drum rotatably mounted with the tank and adapted to provide a source of aqueous, oxidizing, chloride-ion-containing wash medium; (c) means for the introduction of bleached pulp suspension to be washed in the vat; (d) means for the withdrawal of washed, bleached pulp suspension from the vat; (e) means electrically connecting the stainless steel washing drum to a source of negative DC voltage, thereby to induce the drum to act as a cathode; (f) a robust anode means electrically connected to a source of positive DC voltage disposed parallel to the longitudinal axis of the drum and secured to the bottom of the vat along the central longitudinal axis of the vat by electrically non-conductive mounting means; and (g) control means for impressing a protection potential to the stainless steel drum at a predetermined voltage in the range of $-600$ to $+400$ $mV_{Ag/AgCl}$, the predetermined voltage being sufficiently low to draw the stainless steel into a passive corrosion protection zone, but which is not sufficiently low to draw the stainless steel into a zone of uniform corrosion.

(iii) Other Features of the Invention

The oxidizing bleach liquor environment in the method embodiment of this invention may contain up to 250 ppm $Cl_2$ and up to 10,000 ppm $Cl^-$; or may contain up to 250 ppm $ClO_2$ and up to 5,000 ppm $Cl^-$; or may contain 250 ppm $OCl^-$ and up to 5,000 ppm $Cl^-$.

In the apparatus embodiment of this invention, the anode may be adhesively secured within a well at the bottom of the vat. Preferably, in this embodiment, the anode is cemented within the well so that the upper surface of the anode is flush with the normal bottom surface of the vat.

Alternatively, in the apparatus embodiment of this invention, the anode may be secured to the bottom of the vat by a plurality of spaced-apart, generally U-shaped clamps, the legs of which are rigidly secured within cooperating apertures in the bottom of the vat.

By another preferred embodiment of this apparatus, the anode is formed of platinized niobium.

BRIEF DESCRIPTION OF THE DRAWING

In the accompanying drawings.

Figure 1:
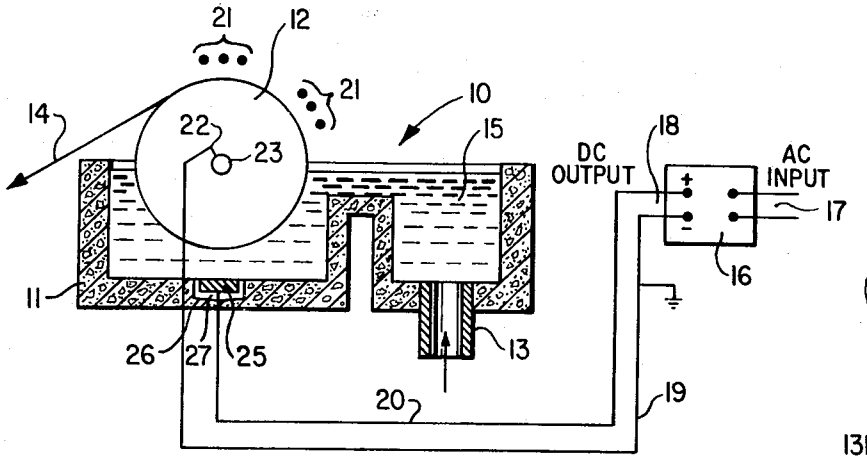
FIG. 1 is a central transverse cross-section of a bleach plant washer according to one embodiment of the present invention, showing one manner of securing the anode to the bottom of the bleach plant washer vat.

DESCRIPTION OF PREFERRED EMBODIMENTS (i) Detailed Description of FIG. 1

As seen in FIG. 1, the bleach plant washer 10 includes a vat 11, preferably made of a material which can withstand the corrosive environment, e.g. brick or ceramic. Rotatably mounted within the vat 11 is a stainless steel perforated or foraminous washing drum 12. Pulp suspension to be washed is admitted through inflow pipe 13, and washed pulp is withdrawn at 14. The pulp is washed by means of shower pipes 21 mounted above the drum 12 and parallel to the axis of rotation of the drum 12, and through which a corrosive washing liquor passes onto the surface of the drum 12. The corrosive liquor, admitted to the vat 11 along with the pulp suspension through flow pipe 13, combines with the washing liquor to form a corrosive liquor/pulp suspension 15 containing residual oxidant (e.g. 50 ppm $Cl_2$) and chloride ions (e.g. 10,000 ppm $Cl^-$) at a predetermined temperature (e.g. 50° C.) and pH (e.g. 1.2) within the vat 11.

Electrochemical corrosion protection for the stainless steel drum 12 is provided by means of power source 16 having an AC input 17 and DC output 18, provided by grounded cathode line 19 and anode line 20. Cathode line 19 is connected by a rotating mercury contact 22 on the central shaft 23 of the drum 12 to induce the drum to act as a cathode. A robust anode 25 of a suitable corrosion-resistant metal e.g. platinized niobium, is electrically connected via line 20 to a source of positive D.C. voltage. Anode 25 is secured to the bottom of the vat 11 within a well 26 extending along the central longitudinal axis of the vat 11 by electrically non-conductive mounting means, e.g. cement or adhesive 27. The power source 16 is provided with central means (not shown) to permit application of a predetermined range of voltage which will be further described hereinafter.

Figure 2:
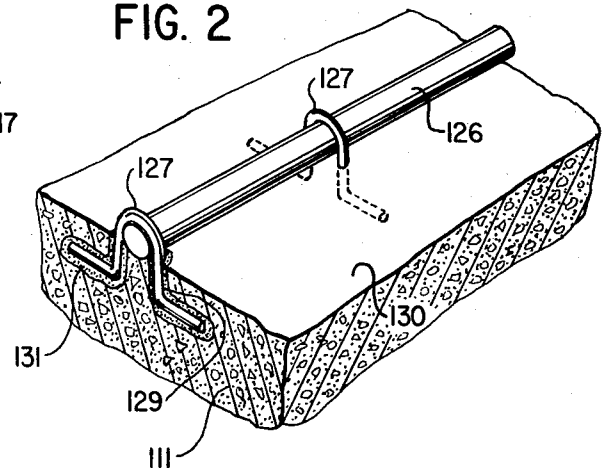
FIG. 2 is a perspective view of a portion of the bottom of the bleach plant washer showing an alternative manner of securing the anode to the bottom of the bleach plant washer vat.

(ii) Detailed Description of FIG. 2

As seen in FIG. 2, the anode 126, rather than being a rectangular bar, is a cylindrical rod. Anode rod 126 is secured to the bottom 130 of the tank 111 by means of a plurality of spaced-apart, generally U-shaped clamps 127, formed of electrically non-conductive material, e.g. polyvinylchloride. The legs 128 thereof are placed in holes 129 in the bottom 130 of the tank 111 and are secured in place by adhesive or cement 131.

(iii) Operation of Preferred Embodiment

In operation, the stainless steel drum 12 in the vat 11 containing the corrosive chloride-containing liquor at a pH in the range of 1.2 to 11 and at a temperature of 25° to 80° C. is rotated so that each portion of the drum 12 is periodically in contact with, and out of contact with, the liquor 15. A predetermined negative voltage is impressed on the drum 12 to draw the drum 12 into a zone of passive corrosion protection. The voltage is selected to draw the drum 12 into the passive zone at that particular pH and temperature, chloride-ion and residual oxidant concentrations. The voltage, however, is not less than a predetermined voltage which is sufficient to draw the drum 12 into a zone of general attack. The voltage necessary to draw the drum 12 into the zone of general attack is also determined at that particular pH, and temperature, chloride ion and residual oxidant concentration.

(iv) Examples

The bleach plant washer of one embodiment of this invention may be operated according to the method of another embodiment of this invention to provide electrochemical protection to the stainless steel drum. This is verified by three experiments, which are summarized hereafter.

EXPERIMENT 1

This series of experiments was conducted in two parts, using stainless steels specimen coupons of 316L stainless steel, 317L stainless steel, 904L stainless steel (a stainless steel made by Uddeholms, Aktiebolag, Sweden, with 20% Cr, 24% Ni, 4.5% Mo;) and of 254S MO stainless steel (a stainless steel made by Avesta Jernverks AB, Sweden, with 20% Cr, 18% Ni, 6% Mo and 0.2% N.).

The coupons were immersed for 24 hours in simulated bleach washer filtrate, with 10,000 ppm $Cl^-$, 40 to 60 ppm $Cl_2$ at 50° C. and pH 1.2 for Part 1; Part 2 used an environment with 1,000 ppm $Cl^-$, 40 to 60 ppm $Cl_2$ at 35° C. and pH 2. Each specimen was mounted on a monitor assembly similar to that disclosed and claimed in copending application Ser. No. 132,026 filed Mar. 20, 1980 (agents file no. PD4063) using a RULON A crevicing disc which formed 20 separated crevices per specimen. (RULON A is the trade mark of DuPont for a filled tetrafluoroethylene resin). The severity of attack was assessed by counting how many of the 20 crevices had initiated on each specimen after the 24 hour immersion. Potentials were controlled using a potentiostat. The results are shown in Table I below.

TABLE I

| | Specimen Type | Control Potential $mV_{Ag/AgCl}$ | Type of Corrosion* | Number of Crevices Initiated |
|---|---|---|---|---|
| Part 1 | 316L | −200 | GA | 0 |
| | | −100 | CC | 2/200 |
| | | | CC,PC | 17/20 |
| | 317L | −200 | GA | 0 |
| | | −100 | NA | 0 |
| | | 0 | CC,PC | 17/20 |
| | | +100 | CC,PC | 20/20 |
| | 904L | −200 | GA | 0 |
| | | −100 | NA | 0 |
| | | 0 | NA | 0 |
| | | +100 | CC,PC | 11/20 |
| | | +200 | CC,PC | 20/20 |
| | 254SMO | −200 | GA | 0 |
| | | −100 | NA | 0 |
| | | 0 | NA | 0 |
| | | +100 | NA | 0 |
| | | +200 | CC | 2/20 |
| | | +300 | CC | 8/20 |
| Part 2 | 254SMO | −300 | GA | 0 |
| | | −200 | NA | 0 |
| | | −100 | NA | 0 |
| | | 0 | NA | 0 |
| | | +100 | NA | 0 |
| | | +200 | NA | 0 |
| | | +300 | NA | 0 |
| | | +400 | CC | 2/20 |

*GA — General Attack
NA — No Attack
CC — Crevide Corrosion
PC — Pitting Corrosion With no potential control, all four types of steel suffer crevice corrosion attack in this environment.

It can be seen from the above table that potential control in a given range for a given steel can be used to prevent the initiation of crevice and pitting corrosion, and at the same time the problem of general attack of the steel may be avoided. The potential ranges for protection lie within the bounds of −200 and 0 $mV_{Ag/AgCl}$ for 317L, −200 and +100 $mV_{Ag/Cl}$ for 904L and −200 and +200 $mV_{Ag/AgCl}$ for 254SMO for the particular simulated bleach washer environment used in Part 1. Whether or not 316L may be protected in this environment is not revealed by this experiment. For the environment employed in Part 2 of this experiment, the potential range for protection of 254SMO lies within the bounds −300 and +400 $mV_{Ag/AgCl}$.

EXPERIMENT 2

A two part experiment was conducted in which 316L and 317L stainless steel specimen coupons were immersed in a simulated bleach plant washer filtrate with 1000 ppm $Cl^-$, 70 to 100 ppm $ClO_2$ at 65° and a pH of 3.0 for part 1; part 2 also included the initial addition of sufficient $SO_2$ to bring the $ClO_2$ concentration to zero. Each specimen was mounted on a monitor assembly similar to that disclosed and claimed in the above identified copending application Ser. No. 132,026 filed Mar. 20, 1980 (agents file No. 10245) using a RULON A crevicing disc which formed 20 separate crevices per specimen. The severity of attack was assessed by counting how many of these 20 crevices had initiated on each specimen. The results are shown in Table II below.

TABLE II

| Specimen # | Specimen Type | Control Potential $mV_{Ag/AgCl}$ | Type of Corrosion* | Number of Crevices Initiated |
|---|---|---|---|---|
| Part 1: (No $SO_2$ Additions) | | | | |
| 1 | 316L | −100 | NA | 0 |
| 2 | 316L | −200 | NA | 0 |
| 3 | 317L | −100 | NA | 0 |
| 4 | 317L | −200 | NA | 0 |
| 5 | 316L | Not controlled | CC | 20/20 |
| 6 | 317L | Not controlled | CC | 8/20 |
| Part 2: (With $SO_2$) | | | | |
| 1 | 316L | −100 | NA | 0 |
| 2 | 316L | −200 | NA | 0 |
| 3 | 317L | −100 | NA | 0 |
| 4 | 317L | −200 | NA | 0 |
| 5 | 316L | Not controlled | CC | 9/20 |
| 6 | 317L | Not controlled | CC | 4/20 |

*NA — No Attack
CC — Crevice Corrosion

It can be seen from the above that while specimens under cathodic potential control did not crevice corrode (#1-4 in Parts 1 and 2), those without potential control all suffered crevice corrosion. The effect of $SO_2$ addition was to mitigate but not to eliminate completely crevice corrosion (compare #5 and #6 Part 1 with #5 and #6, Part 2).

With no potential control, the free corrosion potential of the specimen is influenced by both the corroding crevice and the oxidizing power of the external environment. With no $SO_2$ addition, the environment is very oxidizing, free corrosion potentials are in the range 0 to +400 $mV_{Ag/AgCl}$ and crevice corrosion proceeds. When $SO_2$ was added, free corrosion potentials fell somewhat but never went below −50 $mV_{Ag/AgCl}$, being in the range −50 to +380 $mV_{Ag/AgCl}$. From these potentials and subsequent inspection of specimens, it was evident that crevice corrosion occurred despite the $SO_2$ addition. This is because the $SO_2$ addition did not lower the potential to the range required for effective protection.

EXPERIMENT 3

Controlled potential 24 hour immersion tests were also conducted on 304L stainless steel specimen coupons in a simulated bleach water filtrate which contained 2000 ppm $Cl^-$, 200 ppm $OCl^-$, at 65° C. and a pH of 10. Each specimen was mounted on a monitor assembly similar to that disclosed and claimed in the above identified copending application Ser. No. 132,026 filed Mar. 20, 1980 (agents file No. 10245) using a RULON A crevicing disc which formed 20 separate crevices per specimen. The severity of attack was assessed by counting how many of these crevices had initiated on each specimen. The results are shown in Table III below.

TABLE III

| Specimen Type | Control Potential $mV_{Ag/AgCl}$ | Type of Corrosion* | Number of Crevices Initiated |
|---|---|---|---|
| 304L | −600 | NA | 0 |
| " | −500 | NA | 0 |
| " | −400 | NA | 0 |
| " | −300 | NA | 0 |
| " | −200 | NA | 0 |
| " | −100 | CC | 6/20 |
| " | 0 | CC | 17/20 |
| " | +100 | CC | 20/20 |
| " | Not Controlled | CC,PC | 6/20 |

*NA — No Attack
CC — Crevice Corrosion
PC — Pitting Corrosion

From these results it can be seen that crevice corrosion may be avoided by potential control, at least in a range within the bounds of −600 and −100 $mV_{Ag/AgCl}$. Without potential control, crevice and pitting corrosion was found to have initiated within 3 hours of the start of the test. Thus, cathodic polarization at controlled potentials has been highly effective in preventing crevice and pitting corrosion in this typical hypochlorite stage washer filtrate environment.

SUMMARY

It has been thus found that the electrochemical potential control of embodiments of this invention substantially prevent the intitiation of crevice corrosion without any $SO_2$ additions. Thus electrochemical potential control eliminates the need for $SO_2$ antichlor additions and at the same time is a more effective way to control the corrosion of bleach plant washing equipment.

From the foregoing description, one skilled in the art can easily ascertain the essential characteristics of the invention, and without departing from the spirit and scope thereof, can make various changes and modifications of the invention to adapt it to various usages and conditions. Consequently, such changes and modifications are properly equitably, and "intended" to be, within the full range of equivalence of the following claims.

We claim:

1. A method of electrochemically protecting by cathodic polarization a partly submersed, rotating, stainless steel drum in a vat containing a corrosive oxidizing chloride containing bleach liquor which comprises impressing a protection potential to said stainless steel drum at a predetermined voltage in the range of −600 to +400 $mV_{Ag/AgCl}$, said predetermined voltage being sufficiently low to draw said stainless steel into a passive corrosion protection zone but not sufficiently low to draw it into a zone of uniform corrosion.

2. The method of claim 1 wherein the oxidizing bleach liquor contains up to 250 ppm $Cl_2$ and up to 10,000 ppm $Cl^-$.

3. The method of claim 1 wherein the oxidizing bleach liquor contains up to 250 ppm $ClO_2$ and up to 5,000 ppm $Cl^-$.

4. The method of claim 1 wherein the oxidizing bleach liquor contains up to 250 ppm $OCl^-$ and up to 5,000 ppm $Cl^-$.

* * * * *